US008920270B2

(12) United States Patent
DeLap et al.

(10) Patent No.: US 8,920,270 B2
(45) Date of Patent: Dec. 30, 2014

(54) ARROW VANE APPARATUS AND METHOD

(75) Inventors: Christopher K. DeLap, Cottonwood Heights, UT (US); Herbert J. Harris, Stansbury Park, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 7 days.

(21) Appl. No.: 13/539,328

(22) Filed: Jun. 30, 2012

(65) Prior Publication Data

US 2014/0004983 A1 Jan. 2, 2014

(51) Int. Cl.
*F42B 6/06* (2006.01)

(52) U.S. Cl.
CPC ..... *F42B 6/06* (2013.01)
USPC ..... 473/586

(58) Field of Classification Search
USPC ..... 473/578, 585, 586; 416/223 R, 243
See application file for complete search history.

(56) References Cited

U.S. PATENT DOCUMENTS

| | | | | |
|---|---|---|---|---|
| 2,358,985 | A | 9/1944 | McAndrew | |
| D172,821 | S | 8/1954 | Cass | |
| 2,887,319 | A | 5/1959 | Lay | |
| 3,539,187 | A | 11/1970 | Smith | |
| 3,749,623 | A | 7/1973 | Benoit | |
| 3,756,602 | A | 9/1973 | Carella | |
| 3,853,320 | A | 12/1974 | Carella | |
| 3,881,730 | A | 5/1975 | Carella | |
| D243,527 | S | 3/1977 | Schnipke | |
| 4,136,144 | A | 1/1979 | Munger | |
| 4,182,513 | A | 1/1980 | Henderson | |
| 4,202,655 | A * | 5/1980 | Maloof | 416/237 |
| 4,234,192 | A | 11/1980 | Salamone | |
| 4,392,654 | A | 7/1983 | Carella | |
| 4,477,084 | A | 10/1984 | Austin | |
| 4,502,692 | A | 3/1985 | Humphrey | |
| 4,615,552 | A | 10/1986 | Bengtson | |
| 5,024,448 | A | 6/1991 | Barrie | |
| 5,039,110 | A | 8/1991 | Honda | |
| 5,066,017 | A | 11/1991 | Kurland | |
| 5,423,553 | A | 6/1995 | Krieg | |
| 5,427,385 | A | 6/1995 | Conrad et al. | |
| 5,465,981 | A * | 11/1995 | Klaus | 473/586 |

(Continued)

FOREIGN PATENT DOCUMENTS

| | | |
|---|---|---|
| DE | 198810059 U1 | 9/1988 |
| DE | 102004023757 | 12/2005 |

(Continued)

OTHER PUBLICATIONS

PCT International Search Report for International Application No. PCT/US2013/046080, mailed Sep. 20, 2013 (6 pp.).

*Primary Examiner* — John Ricci
(74) *Attorney, Agent, or Firm* — Holland & Hart

(57) ABSTRACT

An arrow may comprise a shaft, an arrowhead, a nock and at least one vane. The shaft may comprise an elongated structure having the arrowhead located at a first end and the nock located at the second end. The at least one arrow vane may be located on the shaft proximate to the second end. The at least one arrow vane may comprise a base attached to the arrow shaft, and a body with convex major surfaces extending from a leading edge to a trailing edge. Methods of manufacturing such an arrow vane may comprise injecting a foamed polymer into a mold and curing the foamed polymer within the mold.

28 Claims, 5 Drawing Sheets

(56) References Cited

U.S. PATENT DOCUMENTS

| | | | | |
|---|---|---|---|---|
| 5,846,147 | A * | 12/1998 | Basik | 473/586 |
| 6,142,896 | A | 11/2000 | Simo et al. | |
| 6,149,479 | A * | 11/2000 | Redmon et al. | 441/79 |
| 6,220,978 | B1 | 4/2001 | Schroeder | |
| 6,695,727 | B1 | 2/2004 | Kuhn | |
| 6,958,023 | B2 | 10/2005 | Simo et al. | |
| 7,331,888 | B2 | 2/2008 | Jirles | |
| 7,914,406 | B2 | 3/2011 | Andrews | |
| 8,038,552 | B2 | 10/2011 | Song | |
| 8,105,189 | B1 | 1/2012 | Huang | |
| 2006/0258491 | A1 | 11/2006 | Walsh | |
| 2007/0173359 | A1 | 7/2007 | Mowery et al. | |
| 2008/0242456 | A1 | 10/2008 | Harsh | |
| 2009/0074578 | A1 | 3/2009 | Dewar et al. | |

FOREIGN PATENT DOCUMENTS

| | | |
|---|---|---|
| FR | 2387671 | 11/1978 |
| GB | 601474 | 5/1948 |
| JP | 61063595 | 4/1986 |
| WO | 2011069505 | 6/2011 |

* cited by examiner

ARROW VANE APPARATUS AND METHOD

TECHNICAL FIELD

In general, the present disclosure relates to arrow vanes, arrows including such vanes, and related manufacturing methods. In particular, the present disclosure relates to arrow vanes including convex surfaces, arrow vanes shaped generally as an airfoil, and arrow vanes including tubercle structures located at an intended leading edge.

BACKGROUND

Arrow vanes are used to "steer" arrows by creating drag at the rear of the arrow, which tends to stabilize the arrow during flight. Arrow vanes or fletching may also be configured to induce spin to facilitate stability of the arrow in flight.

Historically, arrow vanes have been made from specifically cut feathers. Feathers are lightweight and produce a considerable amount of drag. Feathers, however, are not very durable, and do not perform well in wet (e.g., rainy) conditions.

In place of feathers, sometimes extruded, flat plastic arrow vanes are used as fletching. Such arrow vanes are heavier than feather arrow vanes, but are generally much more durable than feather arrow vanes. Additionally, extruded, flat plastic arrow vanes provide less drag than feather arrow vanes, resulting in a slower "recovery" of an arrow as is comes out of the bow. Accordingly, extruded, flat polymer arrow vanes have downsides as compared to other fletching options.

Some plastic arrow vanes are injection molded, with features configured to provide drag, and sometimes to induce spin. Molded plastic arrow vanes, however, are heavy by nature of the materials used, as such they may dramatically slow down an arrow in flight. Accordingly, such arrow vanes may result in arrows that are less efficient and less accurate down range.

In view of the foregoing, improved arrow vanes, arrows including such improved arrow vanes, and related methods would be desirable.

SUMMARY

According to one aspect of the present disclosure, an arrow vane comprises a base configured for attachment to an arrow shaft, and a body with convex major surfaces extending from an intended leading edge to an intended trailing edge.

In an additional aspect, which may be combined with other aspects herein, the body may have a thickness at a central region near the base that is greater than a thickness of a peripheral region.

In an additional aspect, which may be combined with other aspects herein, the body may be shaped as an airfoil.

In an additional aspect, which may be combined with other aspects herein, the body may comprise tubercle structures located at an intended leading edge.

In an additional aspect, which may be combined with other aspects herein, the tubercle structures may extend over at least 30% of a length of the body.

In an additional aspect, which may be combined with other aspects herein, the tubercle structures may extend over at least 50% of the length of the body.

In an additional aspect, which may be combined with other aspects herein, the body may comprise a foam body.

In an additional aspect, which may be combined with other aspects herein, an exterior of the foam body may be denser than an interior of the foam body.

In an additional aspect, which may be combined with other aspects herein, the exterior of the foam body may comprise a closed-cell foam skin.

In an additional aspect, which may be combined with other aspects herein, the body may comprise a thermosetting polymer foam.

In an additional aspect, which may be combined with other aspects herein, the thermosetting polymer foam may comprise at least one of a polyurethane foam, a polyester foam, a polyphenol foam, a polyamide foam, a polyisocyanurate foam, and a polypoxide foam.

In an additional aspect, which may be combined with other aspects herein, the body and base may comprise a monolithic structure.

In an additional aspect, which may be combined with other aspects herein, the body may comprise at least two components joined together.

In an additional aspect, which may be combined with other aspects herein, the body may be hollow.

According to another aspect of the present disclosure, an arrow may comprise a shaft, an arrowhead, a nock and at least one arrow vane. The shaft may comprise an elongated structure having the arrowhead located at a first end and the nock located at the second end. The at least one arrow vane may be located on the shaft proximate to the second end. The at least one arrow vane may comprise a base attached to the arrow shaft, and a body with convex major surfaces extending from an intended leading edge to an intended trailing edge.

In an additional aspect, which may be combined with other aspects herein, the body of the at least one arrow vane may be shaped as an airfoil.

In an additional aspect, which may be combined with other aspects herein, the body of the at least one arrow vane may comprise tubercle structures located at an intended leading edge.

In an additional aspect, which may be combined with other aspects herein, the at least one arrow vane may comprise a foam body.

According to another aspect of the present disclosure, a method of manufacturing an arrow vane may comprise injecting a foamed polymer into a mold. The method may further comprise curing the foamed polymer within the mold to form an arrow vane comprising a base configured for attachment to an arrow shaft, and a body with convex major surfaces extending from an intended leading edge to an intended trailing edge.

In an additional aspect, which may be combined with other aspects herein, injecting a foamed polymer into the mold may comprise injecting a first part of a thermosetting polymer and a separate second part of the thermosetting polymer into the mold.

In an additional aspect, which may be combined with other aspects herein, curing the foamed polymer within the mold may comprise reacting the first part of the thermosetting polymer with the second part of the thermosetting polymer within the mold.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
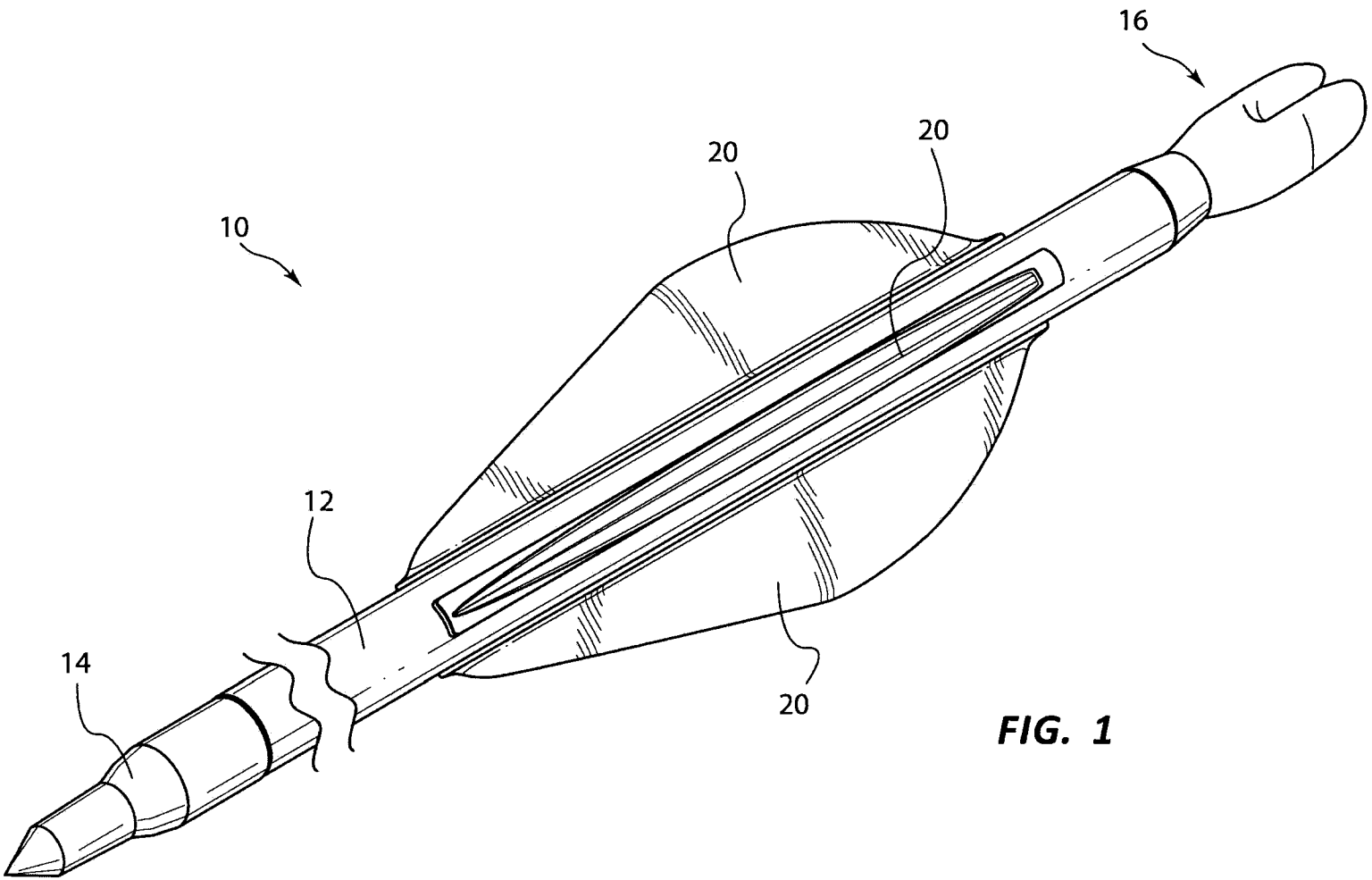
FIG. 1 is an isometric view of an arrow comprising a plurality of arrow vanes, according to an embodiment of the present disclosure.

In some embodiments, as shown in FIG. 1, an arrow 10 may comprise a shaft 12, an arrowhead 14, a nock 16, and at least one arrow vane 20. The shaft 12 may comprise an elongated structure having the arrowhead 14 located at a first end and the nock 16 located at the second end. The shaft 12, arrowhead 14 and nock 16 may take any of a variety of forms that are known in the art.

Figure 2:
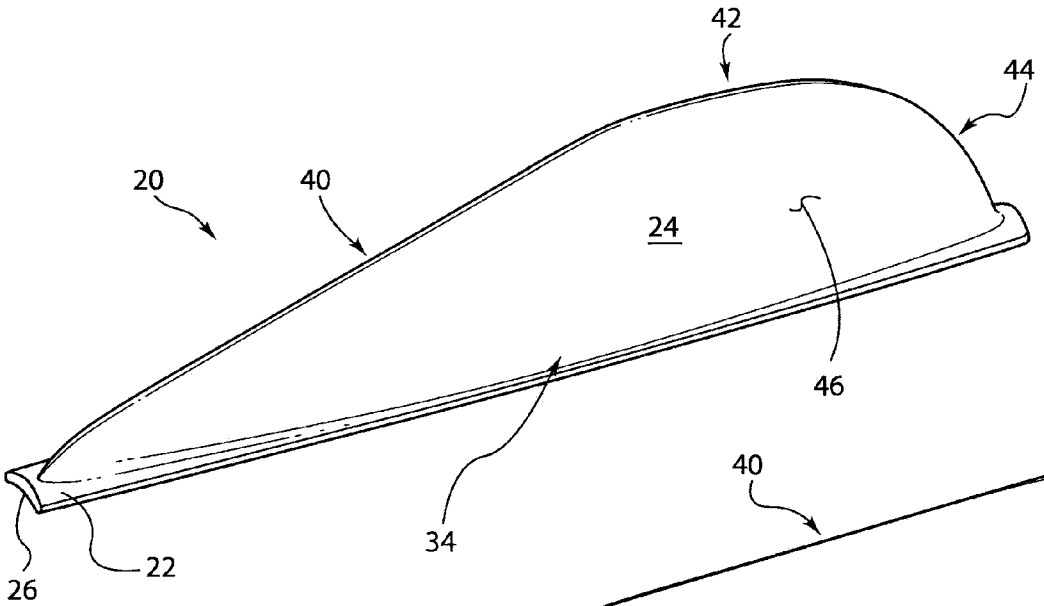
FIG. 2 is an isometric view of an arrow vane, such as shown in FIG. 1.
Figure 3:
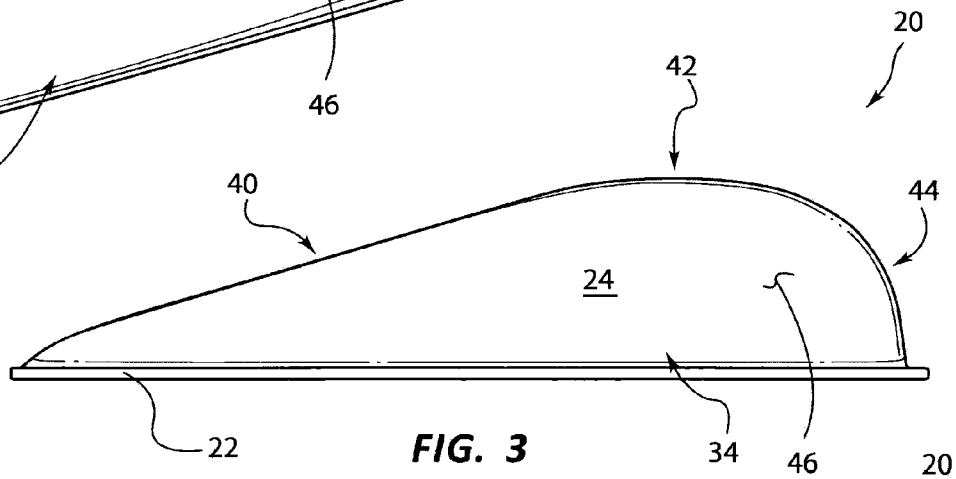
FIG. 3 is a side view of an arrow vane, such as shown in FIG. 1.
Figure 4:
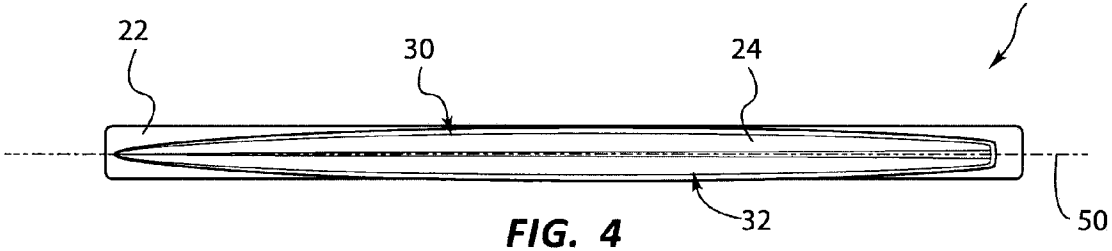
FIG. 4 is a top view of an arrow vane, such as shown in FIG. 1.

Each arrow vane 20 may be located on the shaft 12 proximate to the second end of the shaft 12, near the nock 16. As shown in FIGS. 2-4, each arrow vane 20 may include a base 22 configured for attachment to the shaft 12 of the arrow 10, and a body 24. The base 22 of the arrow vane 20 may include a curved surface 26 corresponding to a shape of an outer surface of the shaft 12. Accordingly, the curved surface 26 of the base 22 of the arrow vane 20 may be attached to the outer surface of the shaft 12, such as with a suitable adhesive material known to those skilled in the art.

The body 24 of the arrow vane 20 may include a first major surface 30, a second major surface 32, opposing the first major surface 30, as shown in FIG. 4. The body 24 of the arrow vane 20 may also include a central region 34, located near the base, as shown in FIGS. 2 and 3. The body 24 of the arrow vane 20 may additionally include a peripheral region comprising an intended leading edge 40, a top 42, and an intended trailing edge 44, as shown in FIGS. 2 and 3. Both the first and second major surfaces 30, 32 of the body 24 of the arrow vane 20 may comprise a convex surface 46 extending from the intended leading edge 40 to the intended trailing edge 44.

The body 24 of the arrow vane 20 may have a thickness at the central region 34, near the base 22, which is greater than a thickness of the peripheral region. As may be observed in FIGS. 2 and 4, the body 24 of the arrow vane 20 may have an average thickness near the intended leading edge 40 that is less than the average thickness near the central region 34. Likewise, the body 24 of the arrow vane 20 may have an average thickness near the intended trailing edge 44 that is less than the average thickness near the central region 34. Additionally, the body 24 of the arrow vane 20 may have an average thickness near the top 42 that is less than the average thickness near the base 22.

The major surfaces 30, 32 of the body 24 of the arrow vane 20 may be relatively smooth, and the body 24 may be shaped generally as an airfoil. For example, the body 24 may have a shape similar to a wing of an aircraft, a propeller blade, a fin, or another airfoil. Accordingly, the airfoil shape of the body 24 of the arrow vane 20 may be configured to cause a pressure differential between the first major surface 30 and the second major surface 32 of the arrow vane 20, which may cause the arrow 10 to spin during flight. Spinning of the arrow 10 may create a gyroscopic effect, due to the rotational inertia of the arrow 10, which may cause the arrow 10 to be more stable during flight.

The arrow vane 20, including the body 24 and the base 22, may be comprised of a foam material, such as a thermosetting polymer (e.g., thermosetting polymer foam) or any suitable thermoplastic material. For example, the arrow vane 20 may be comprised of one or more of a polyurethane foam, a polyester foam, a polyphenol foam, a polyamide foam, a polyisocyanurate foam, a polypoxide foam, or other thermosetting polymer material. In another example, the arrow vane 20 may be comprised of one or more of a thermoplastic polyurethane (TPU) and a thermoplastic elastomer (TPE).

Accordingly, the body 24 and base 22 of the arrow vane 20 may comprise a monolithic foam structure that is molded in one piece. In further embodiments, the arrow vane 20 may comprise at least two components joined together. For example, a first side of the arrow vane, including the first major surface 30 and a first lateral half of the base 22 may be molded separately from a second side of the arrow vane 20, including the second major surface 32 and a laterally opposing second half of the base 22. The first side of the arrow vane 20 may be symmetrical to the second side of the arrow vane 20, and the two sides of the arrow vane 20 may be joined together at a plane of symmetry 50 (see FIG. 4), such as with an adhesive material, to form the arrow vane 20.

As the body 24 of the arrow vane 20 may be a foam body, the exterior of the body 24 may be denser than an interior of the body 24. In some embodiments, the foam material forming the body 24 of the arrow vane 20 may be a self-skinning foam material and the exterior of the arrow vane 20 may be a relatively smooth foam surface. For example, the exterior of the body 24 may comprise a closed-cell foam skin. Additionally, the body 24 of the arrow vane 20 may have a hollow region in the interior thereof.

Figure 5:
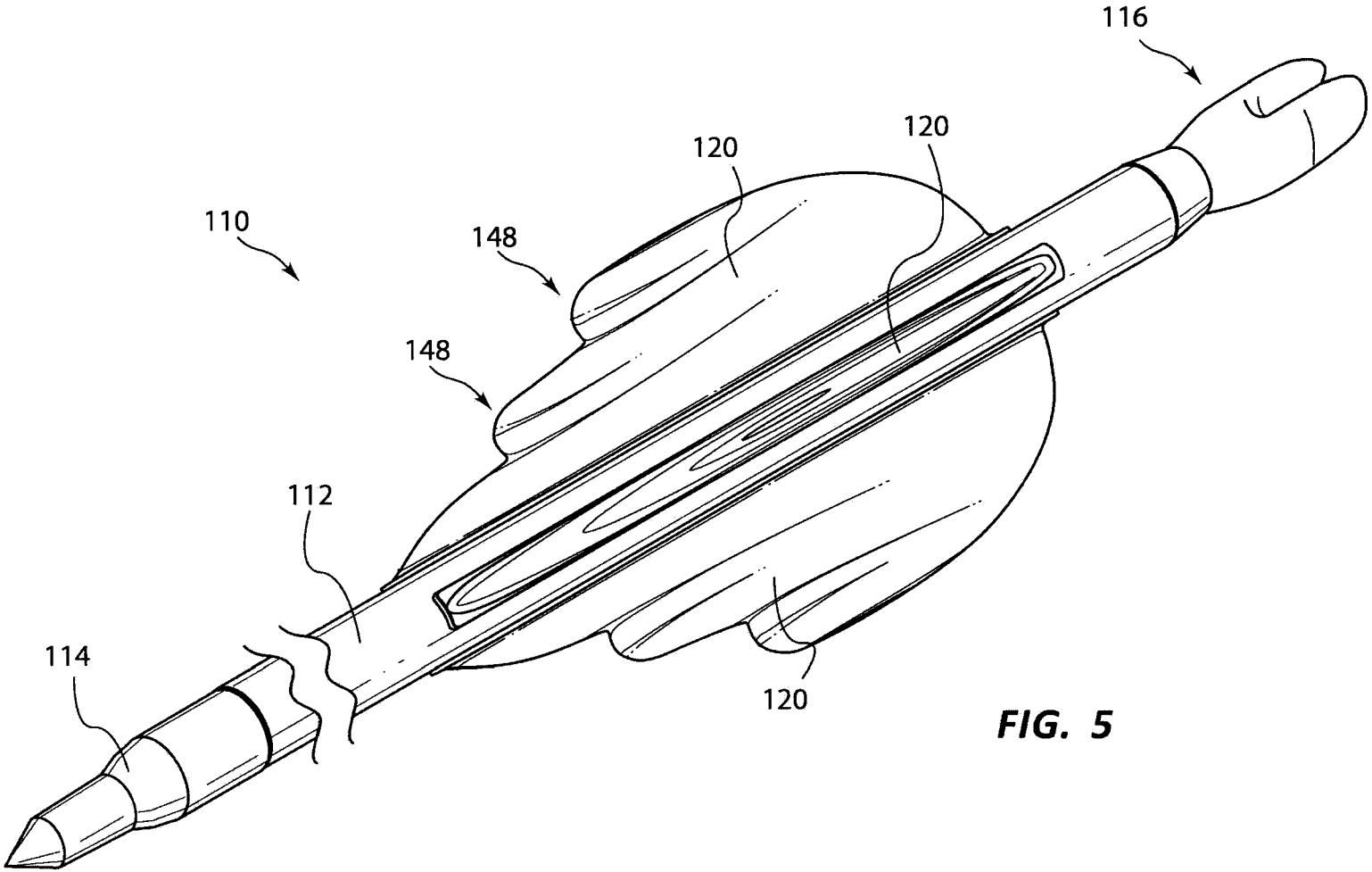
FIG. 5 is an isometric view of an arrow comprising a plurality of arrow vanes having tubercle structures located at an intended leading edge, according to an embodiment of the present disclosure.
Figure 6:
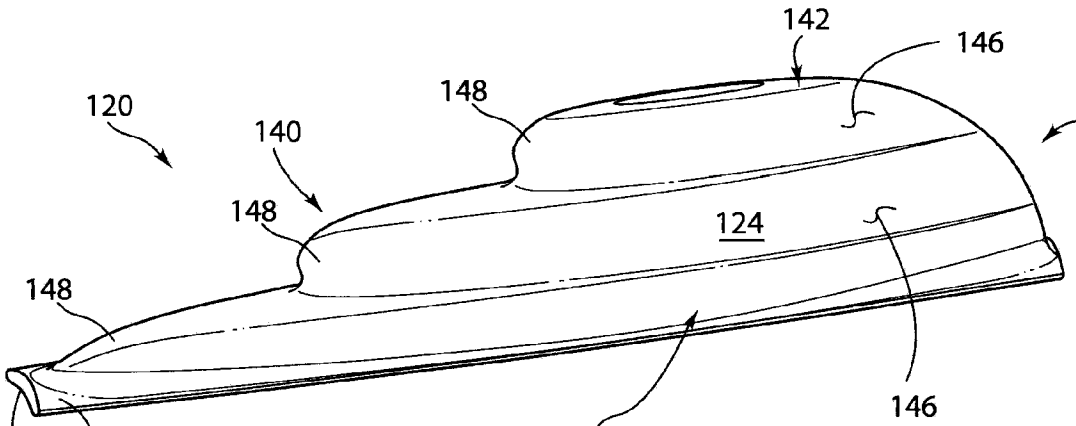
FIG. 6 is an isometric view of an arrow vane having tubercle structures located at an intended leading edge, such as shown in FIG. 5.
Figure 7:
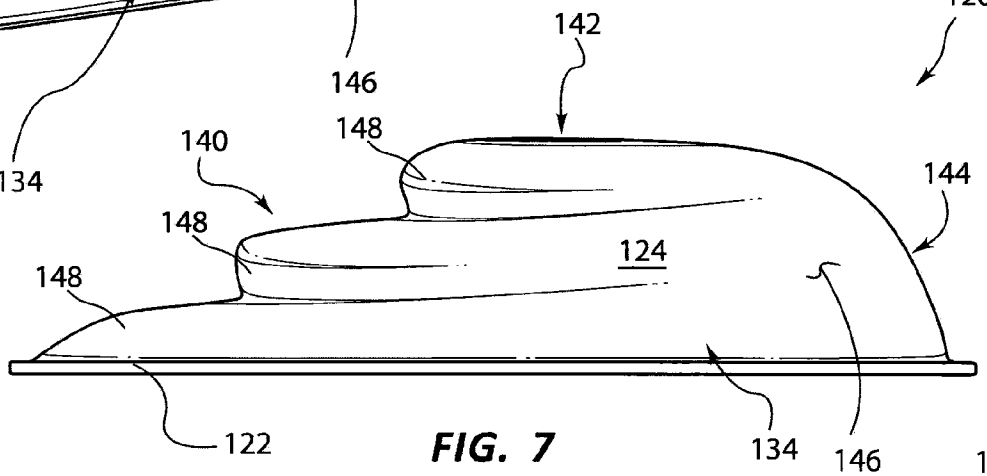
FIG. 7 is a side view of an arrow vane having tubercle structures located at an intended leading edge, such as shown in FIG. 5.
Figure 8:
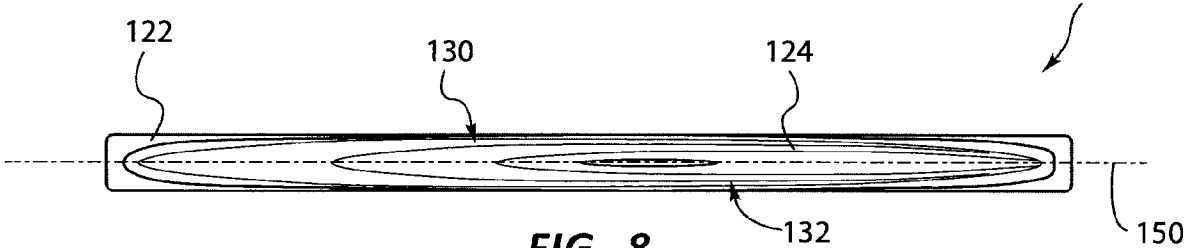
FIG. 8 is a top view of an arrow vane having tubercle structures located at an intended leading edge, such as shown in FIG. 5.

In further embodiments, as shown in FIG. 5, an arrow 110 may comprise a shaft 112, an arrowhead 114, a nock 116, and at least one arrow vane 120 comprising tubercle structures 148. As shown in FIGS. 6-8, each arrow vane 120 may include a base 122 configured for attachment to the shaft 112 of the arrow 110, and a body 124. Similar to the arrow vane 20 (see FIGS. 2-4), the base 122 of the arrow vane 120 may include a curved surface 126 corresponding to a shape of an outer surface of the shaft 112. Accordingly, the curved surface 126 of the base 122 of the arrow vane 120 may be attached to the outer surface of the shaft 112, such as with an adhesive material.

The body 124 of the arrow vane 120 may include a first major surface 130, and a second major surface 132, opposing the first major surface 130, as shown in FIG. 8. The body 124 of the arrow vane 120 may also include, a central region 134 located near the base 122, and a peripheral region comprising an intended leading edge 140, a top 142, and an intended trailing edge 144, as shown in FIGS. 6 and 7. Both the first and second major surfaces 130, 132 of the arrow vane 120 may comprise a plurality of convex surfaces 146 extending from the intended leading edge 140 to the intended trailing edge 144.

Similar to the arrow vane 20, the body 124 of the arrow vane 120 may have a thickness at the central region 134, near the base 122, which is greater than a thickness of the peripheral region. As may be observed in FIGS. 6 and 8, the body 124 of the arrow vane 120 may have an average thickness near the intended leading edge 140 that is less than the average thickness near the central region 134. Likewise, the body 124 of the arrow vane 120 may have an average thickness near the intended trailing edge 144 that is less than the average thickness near the central region 134. Additionally, the body 124 of the arrow vane 120 may have an average thickness near the top 142 that is less than an average thickness near the base 122.

The tubercle structures 148 (e.g., relatively smooth, rounded protrusions) may be located at the intended leading edge 140 of the arrow vane 120, and may extend from the intended leading edge 140 toward the intended trailing edge 144 of the arrow vane 120. The tubercle structures 148 may provide a generally corrugated profile at the leading edge 144 of the arrow vane 120. The trailing edge 144 of the arrow vane 120 may be relatively smooth, without any tubercle structures 148 located thereon. In some embodiments, the tubercle structures 148 may extend longitudinally over at least 30% of a length of the body 124. In further embodiments, the tubercle structures 148 may extend longitudinally over at least 50% of the length of the body 124.

As shown in FIGS. 5-8, each arrow vane 120 may include three tubercle structures 148 located at the intended leading edge 140. In further embodiments, each arrow vane 120 may include any number of tubercle structures 148, and may include more than three tubercle structures 148 located at the intended leading edge 140, or less than three tubercle structures 148 located at the intended leading edge 140.

Similar to the arrow vane 20, the body 124 of the arrow vane 120 may be shaped generally as airfoil, except that the airfoil includes tubercle structures 148 at the intended leading edge 140 thereof. For example, the body 124 of the arrow vane 120 may have a shape similar to a wing of an aircraft, a propeller blade, a fin, or another airfoil including tubercle structures 148 at the intended leading edge 140 thereof. Accordingly, the airfoil shape may be configured to cause a pressure differential between the first major surface 130 and the second major surface 132 of the arrow vane 120, which may cause the arrow 110 to spin in flight. Spinning of the arrow 110 may create a gyroscopic effect, due to the rotational inertia of the arrow 110, which may cause the arrow 110 to be more stable during flight.

The tubercle structures 148 on the intended leading edge 140 of the body 124 of the arrow vane 120 may induce turbulence in the airflow past the arrow vane 120, which may inhibit flow separation. This may result in increasing a rotational speed of the arrow 110 at which flow separation (i.e., aerodynamic stall) may occur. As flow separation may increase drag, an arrow 110 comprising arrow vanes 120 having tubercles 148 located at an intended leading edge 140 as described herein may spin during flight and experience less drag than an identically moving arrow having conventional arrow vanes.

Similar to the arrow vane 20, the arrow vane 120, including the body 124 and the base 122, may be comprised of a foam material, such as a thermosetting polymer foam. For example, the arrow vane 120 may be comprised of one or more of a polyurethane foam, a polyester foam, a polyphenol foam, a polyamide foam, a polyisocyanurate foam, and a polypoxide foam.

Accordingly, the body 124 and base 122 may comprise a monolithic foam structure that is molded in one piece. In further embodiments, the arrow vane 120 may comprise at least two components joined together. For example, a first side of the arrow vane 120, including the first major surface 130 and a first lateral half of the base 122 may be molded separately from a second side of the arrow vane 120, including the second major surface 132 and a laterally opposing second half of the base 122. The first side of the arrow vane 120 may be symmetrical to the second side of the arrow vane 120, and the two sides of the arrow vane 120 may be joined together at a plane of symmetry 150 (see FIG. 8), such as with an adhesive material, to form the arrow vane 120.

As the body 124 of the arrow vane 120 may be a foam body, the exterior of the body 124 may be denser than an interior of the body 124. In some embodiments, the foam material forming the body 124 of the arrow vane 120 may be a self-skinning foam material and the exterior of the arrow vane 120 may be a relatively smooth foam surface. For example, the exterior of the body 124 of the arrow vane 120 may comprise a closed-cell foam skin. Additionally, the body 124 of the arrow vane 120 may have a hollow region in the interior thereof.

Figure 9:
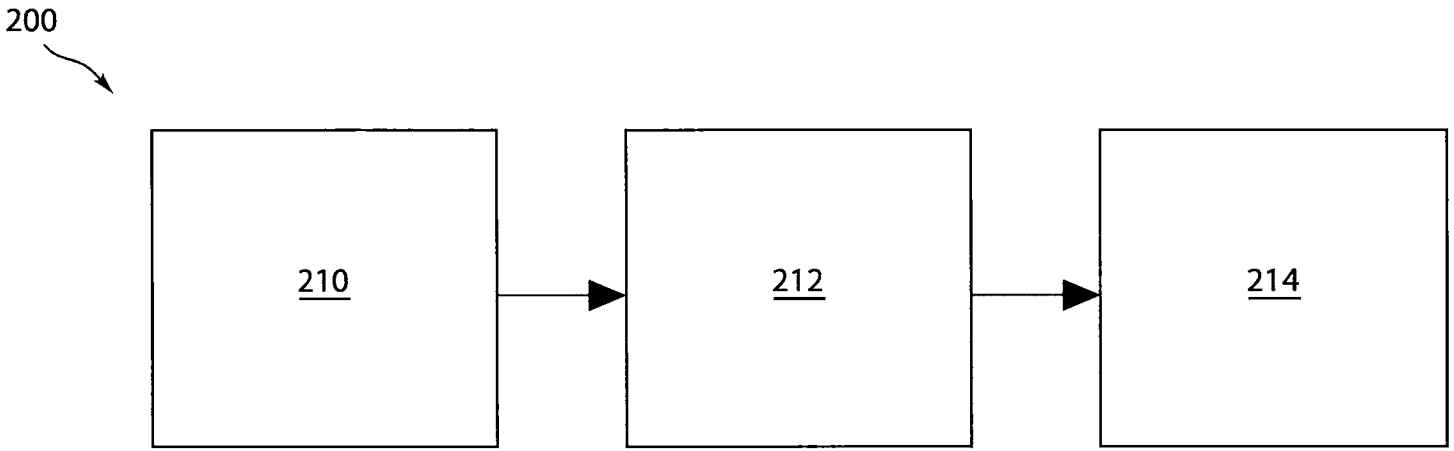
FIG. 9 is a schematic view of a process for manufacturing an arrow vane, according to an embodiment of the present disclosure.

In some embodiments, an injection molding process 200 may be utilized to manufacture an arrow vane 20, 120, as illustrated in FIG. 9. The injection molding process 200 may include injecting a foamed polymer into a mold 210 and curing the foamed polymer within the mold 212 to form the arrow vane 20, 120. After the foamed polymer has cured, the finished arrow vane 20, 120, comprising a base 22, 122 configured for attachment to an arrow shaft 12, 112 and a body 24, 124 with convex major surfaces 46, 146 extending from an intended leading edge 40, 140 to an intended trailing edge 44, 144, may be removed from the mold 214.

Injecting the foamed polymer into the mold 210 may comprise reaction injection molding (RIM) process. The reaction injection molding process may include injecting a first part of a thermosetting polymer into the mold, and substantially simultaneously injecting a separate second part of the thermosetting polymer into the mold. The two-part thermosetting polymer comprising at least one of a polyurethane foam, a polyester foam, a polyphenol foam, a polyamide foam, a polyisocyanurate foam, and a polypoxide foam. For example, the first part of the thermosetting polymer may comprise polyisocyanate and the second part of the thermosetting polymer may comprise polyol and a blowing agent.

After the first and second parts of the thermosetting polymer have been injected into the mold 210, curing the foamed polymer within the mold 212 may comprise reacting the first part of the thermosetting polymer with the second part of the thermosetting polymer within the mold forming a monolithic foam arrow vane 20, 120.

The reaction injection molding process may facilitate light-weight foam arrow vanes 20, 120 having a relatively high density skin and a relatively low density core. Additionally, reaction injection molding may facilitate relatively quick cycle times and require relatively low clamping forces.

In further embodiments, an arrow vane 20, 120 may be manufactured utilizing two separate molds. A first mold may include a cavity wall defining a cavity therein, the cavity wall comprising features to define a first major surface 30, 130 and a first lateral half of a base 22, 122. A second mold may include a cavity wall defining a cavity therein, the cavity wall comprising features to define a second major surface 32, 132 and a second lateral half of the base 22, 122. The cavity walls of the first mold and the second mold may be symmetrical and define symmetrical cavities. Accordingly, separate and symmetrical parts may be formed in the respective first and second molds by an injection molding process.

The symmetrical parts may then be joined together at a plane of symmetry 50, 150, such as by an adhesive material, to form an arrow vane 20, 120. By joining two separate parts to form the arrow vane 20, 120, the arrow vane 20, 120 may be manufactured to include a hollow cavity, thus reducing the overall weight of the arrow vane 20, 120. In view of this, such a process may utilize polymers that are not foamed and that are relatively dense and strong, and still provide a relatively lightweight arrow vane 20, 120.

Arrows 10, 110 including arrow vanes 20, 120, such as described herein, may have improved steering (i.e., fly along a more consistent and repeatable path) compared to arrows including conventional arrow vanes. Additionally, arrows 10, 110 including arrow vanes 20, 120, such as described herein, may be more accurate at greater distances and retain more kinetic energy on impact compared to arrows including conventional arrow vanes. Such improvements may be desirable by both hunting and target archers alike.

The preceding description has been presented only to illustrate and describe exemplary embodiments of the invention. It is not intended to be exhaustive or to limit the invention to any precise form disclosed. Many modifications and variations are possible in light of the above teaching. It is intended that the scope of the invention be defined by the following claims.

What is claimed is:

1. An arrow vane in combination with an arrow shaft, the arrow vane comprising:
- a base configured for attachment to the arrow shaft;
- a body with convex major surfaces extending from a leading edge to a trailing edge.

2. The arrow vane in combination with an arrow shaft of claim 1, wherein the body has a thickness at a central region near the base that is greater than a thickness of a peripheral region.

3. The arrow vane in combination with an arrow shaft of claim 2, wherein the body is shaped as an airfoil.

4. The arrow vane in combination with an arrow shaft of claim 1, wherein the body comprises tubercule structures located at the leading edge.

5. The arrow vane in combination with an arrow shaft of claim 4, wherein the tubercule structures extend over at least 30% of a length of the body.

6. The arrow vane in combination with an arrow shaft of claim 5, wherein the tubercule structures extend over at least 50% of the length of the body.

7. The arrow vane in combination with an arrow shaft of claim 1, wherein the body comprises a foam body.

8. The arrow vane in combination with an arrow shaft of claim 7, wherein an exterior of the foam body is denser than an interior of the foam body.

9. The arrow vane in combination with an arrow shaft of claim 8, wherein the exterior of the foam body comprises a closed-cell foam skin.

10. The arrow vane in combination with an arrow shaft of claim 1, wherein the body comprises a thermosetting polymer foam.

11. The arrow vane in combination with an arrow shaft of claim 10, wherein the thermosetting polymer foam comprises at least one of a polyurethane foam, a polyester foam, a polyphenol foam, a polyamide foam, a polyisocyanurate foam, and a polypoxide foam.

12. The arrow vane in combination with an arrow shaft of claim 1, wherein the body and base comprise a monolithic structure.

13. The arrow vane in combination with an arrow shaft of claim 1, wherein the body comprises at least two components joined together.

14. The arrow vane in combination with an arrow shaft of claim 1, wherein the body is hollow.

15. An arrow comprising:
- a shaft having a first end and an opposing second end;
- an arrowhead located at the first end of the shaft;
- a nock located at the second end of the shaft;
- at least one arrow vane located on the shaft proximate to the second end, the at least one arrow vane comprising:
  - a base attached to the arrow shaft;
  - a body with convex major surfaces extending from a leading edge to a trailing edge.

16. The arrow of claim 15, wherein the body of the at least one arrow vane is shaped as an airfoil.

17. The arrow of claim 15, wherein the body of the at least one arrow vane comprises tubercle structures located at the leading edge.

18. The arrow of claim 15, wherein the at least one arrow vane comprises a foam body.

19. An arrow vane comprising:
- a base configured for attachment to an arrow shaft;
- a body with convex major surfaces extending from a leading edge to a trailing edge, the body further comprising tubercule structures located at the leading edge.

20. The arrow vane of claim 19, wherein the tubercule structures extend over at least 30% of a length of the body.

21. The arrow vane of claim 20, wherein the tubercule structures extend over at least 50% of the length of the body.

22. An arrow vane comprising:
- a base configured for attachment to an arrow shaft;
- a body with convex major surfaces extending from a leading edge to a trailing edge, the body comprising a foam body.

23. The arrow vane of claim 22, wherein an exterior of the foam body is denser than an interior of the foam body.

24. The arrow vane of claim 23, wherein the exterior of the foam body comprises a closed-cell foam skin.

25. An arrow vane comprising:
- a base configured for attachment to an arrow shaft;
- a body with convex major surfaces extending from a leading edge to a trailing edge, the body comprising a thermosetting polymer foam.

26. The arrow vane of claim 25, wherein the thermosetting polymer foam comprises at least one polyurethane foam, a polyester foam, a polyphenol foam, a polyamide foam, a polyisocyanurate foam, and a polypoxide foam.

27. An arrow vane in combination with an arrow shaft, the arrow vane comprising:
- a base configured for attachment to the arrow shaft;
- a body with convex major surfaces extending from a leading edge to a trailing edge;
- wherein the body and base comprise a monolithic structure.

28. An arrow vane comprising:
- a base configured for attachment to an arrow shaft;
- a hollow body with convex major surfaces extending from a leading edge to a trailing edge.

* * * * *